US007107628B2

(12) United States Patent
Haaga

(10) Patent No.: US 7,107,628 B2
(45) **Date of Patent: *Sep. 19, 2006**

(54) SAFETY FILTRATION APPAREL

(76) Inventor: John R. Haaga, 4309 N. Hilltop, Chagrin Falls, OH (US) 44022

( * ) Notice: Subject to any disclaimer, the term of this patent is extended or adjusted under 35 U.S.C. 154(b) by 451 days.

This patent is subject to a terminal disclaimer.

(21) Appl. No.: 10/643,498

(22) Filed: Aug. 19, 2003

(65) Prior Publication Data

US 2004/0031490 A1 Feb. 19, 2004

Related U.S. Application Data

(63) Continuation-in-part of application No. PCT/US03/06614, filed on Mar. 4, 2003.

(60) Provisional application No. 60/365,402, filed on Mar. 18, 2002.

(51) Int. Cl.
*A41D 13/00* (2006.01)
*A62D 17/00* (2006.01)

(52) U.S. Cl. ..... 2/457; 2/424; 2/901; 2/173; 2/181; 2/202; 2/207; 128/857; 442/110

(58) Field of Classification Search ..... 2/901, 2/918, 173, 181, 181.4, 456, 457, 410, 424, 2/15, 9, 84, 171.2, 202, 203, 206, 207, 201.25; 128/857; 442/110
See application file for complete search history.

(56) References Cited

U.S. PATENT DOCUMENTS 3,885,558 A * 5/1975 Belkin ..... 128/201.25
4,589,408 A * 5/1986 Singer ..... 128/857
4,870,959 A * 10/1989 Reisman et al. ..... 128/201.25
4,932,078 A * 6/1990 Jones et al. ..... 2/70
H823 H * 10/1990 Conkle et al. ..... 2/410
4,969,457 A 11/1990 Hubbard et al.
5,206,958 A * 5/1993 Widenback ..... 2/457
5,269,024 A * 12/1993 Wyatt ..... 2/173
5,452,712 A * 9/1995 Richardson ..... 128/201.25
5,588,153 A * 12/1996 Ignon et al. ..... 2/457
5,596,985 A 1/1997 Collier
5,682,606 A * 11/1997 Pospisil ..... 2/9
5,784,717 A * 7/1998 Singer ..... 2/79
5,830,810 A * 11/1998 Cohen ..... 442/110
5,937,445 A * 8/1999 Ravo et al. ..... 2/173
5,972,812 A * 10/1999 Sakata et al. ..... 442/243
2004/0055079 A1 3/2004 Haaga

OTHER PUBLICATIONS

3M Health CareFace Masks and Respirators—2004.
3M Health Care Particulate Respirator and Surgical Mask—Jul. 2003.
3M Filtrete.

* cited by examiner

*Primary Examiner*—John J. Calvert
*Assistant Examiner*—Robert H Muromoto

(57) ABSTRACT

Safety apparel and/or non-apparel items that filter from the air one or more airborne particles and/or undesired gasses to provide safety to a human and/or non-human from potentially unhealthy airborne particles. The apparel and/or non-apparel item at least partially includes a filter material. The filter material on the apparel and/or non-apparel item has a sufficient size to enable the human and/or non-human to cover the nose, eyes, and/or mouth of the human and/or non-human. The filter material filters at least one airborne particle and/or undesired gas by a mechanical mechanism, an electrical mechanism, and/or a chemical mechanism. The apparel and/or non-apparel item can include at least one visual and/or textural indicator on the apparel and/or non-apparel item to at least partially indicate the location of the filter material on the apparel and/or non-apparel item.

71 Claims, 3 Drawing Sheets

SAFETY FILTRATION APPAREL

The present invention is a continuation-in-part of co-pending U.S. patent application Ser. No. 10/287,237 filed on Nov. 4, 2002, which in turn claims priority on U.S. patent application Ser. No. 60/365,402 filed Mar. 18, 2002 and U.S. patent application Ser. No. 60/347,922 filed on Nov. 7, 2001. The present invention incorporates by reference co-pending PCT Application Ser. No. PCT/US03/06614 filed Mar. 4, 2003 entitled "Safety Filtration Apparel," and U.S. patent application Ser. No. 60/365,402 filed Mar. 18, 2002 entitled "Safety Filtration Apparel."

The present invention is related to safety fabrics, and more particularly to apparel and/or other types of fabrics that provide at least partial protection from airborne particles.

BACKGROUND OF THE INVENTION

In recent times, there has been some concern for public safety with respect to biological attacks on the public by terrorists or other criminal elements. The potential for biological attacks is believed to be primarily in the form of airborne particles and/or contamination of public water supplies. The public safety concerns have also been raised with respect to various types of infectious diseases (e.g. small pox, SARS, flu, etc).

With respect to airborne particles, the biological agent can be conveyed to individual households and/or to public locations by envelopes, packages and/or the like, which are transported by common mail carriers. In this conveyance mode, the biological agent is typically in powdered form and is dispersed into the air upon opening the envelopes, packages and/or the like. Alternatively, the biological agent can be released into the air by use of an aircraft, detonation of a bomb, releasing the biological agent from atop a building or other type of structure, and/or the like. In each of these situations, the biological agent, typically in powdered form, but alternatively may be in aerosol and/or liquid form, is designed to infect a large number individuals exposed to the biological agent.

Areas of concern for contact with a biological agent include, but are not limited to, outdoor sporting events, outdoor fairs and circuses, large outdoor public gatherings, and the like. Most often, such biological terrorism has little or no warning. As such, the exposed or potentially exposed public has little ability to reduce or prevent exposure to biological agents that are released into such public areas.

With respect to infectious diseases, the infectious disease can be spread from infected individuals to other individuals through close contact and/or actual contact with the infected individual. Areas of concern for contact with an infectious disease include, but are not limited to, outdoor sporting events, outdoor fairs and circuses, large outdoor public gatherings, hospitals and/or other medical facilities, public transportation, public restrooms, public restaurants, and other public areas. Typically, the infected individual is not aware of his/her infectious state and/or the severity of the infection. Consequently, such individuals commonly go to work or go shopping and expose or potentially expose the public. Such exposed or potentially exposed public has little or no warning or ability to reduce or prevent exposure to the infectious individual, potentially resulting in the spread of the infection. Patients and/or staff in medical facilities are sometimes placed at an even higher risk of exposure to infected individuals. Periodically, several patients are placed in waiting rooms and/or treatment rooms that contain several people. The close proximity of people to the infected person can increase the risk of the spread of the infection. In addition, medical personnel move from room to room when treating people. Medical personnel which come in contact with a infected person may spread the infection to others when such medical personnel move to other rooms to treat other patients.

Safety masks are known for use by doctors and their staff to protect the doctor and his/her staff from adverse bacteria, viruses and the like. Painters' masks are also known for use by painters to protect the painter from paint particles in the air during a painting process. Although these types of masks could be used by the public to provide at least some protection from an adverse biological agent, such masks are not commonly used by the public, especially in public areas. This lack of use by the public of such masks can be partially attributed to many people considering the wearing of such masks in public socially and/or fashionably unacceptable. In addition, such masks are an extra accessory that must be packed before traveling to a public area. As such, many people forget to pack and/or purchase such masks when traveling to a public area, thus do not have such masks readily available during a time of need.

In view of the potential dangers of being exposed to adverse biological agents in public areas and/or other areas, there is a need for a protective device that is convenient and readily accessible for use by an individual to provide such individual with a degree of protection from an adverse biological agent.

SUMMARY OF THE INVENTION

The present invention is related to safety fabrics, and more particularly to apparel and/or other types of fabrics that provide at least partial protection from airborne particles and/or gasses. More particularly, the present invention is directed to apparel that is, in many instances, commonly used by individuals, which apparel includes a material that can filter out one or more potentially harmful airborne particles and/or gasses. Such apparel provides an individual with some protection from airborne biological agents until the individual has time to remove oneself from the potentially contaminated area and/or after the danger to infection from the biological agents has at least partially passed.

In accordance with the present invention, there is provided apparel that is made from, or includes one or more pieces of, filter fabric that can filter out one or more airborne particles and/or gasses. The filter fabric can be a woven and/or non-woven material. The filter fabric can be made from natural fibers (e.g. cotton, wool, etc.) and/or from synthetic fibers (e.g. polyester, nylon, polypropylene, etc.). The thickness of the filter fabric can be varied depending on the desired filter efficiencies and/or the region of the apparel where the filter fabric is to be used. The filter fabric can be designed to filter airborne particles and/or gasses by mechanical mechanisms (e.g. weave density), by electrical mechanisms (e.g. charged fibers, charged metals, etc.), and/or by chemical mechanisms (e.g. absorptive charcoal particles, adsorptive materials, etc.). In one embodiment of the invention, the filter material includes electrically charged fibers such as, but not limited to, FILTRETE by 3M. In another and/or alternative embodiment of the invention, the filter material includes a high density material similar to material used for medical masks which are used by medical personnel in doctors' offices, hospitals, and the like. Non-limiting examples of such mask materials are disclosed in U.S. Pat. Nos. 5,596,985; 4,969,457; and 4,589,408 and the United States patents cited and/or referenced therein, all of which are incorporated herein by reference. Other types of masks and the materials used to make the masks include 3M masks such as, but not limited to, the 1800+, 1816, 1818, 1820, 1825, 1826,1838, 1860 masks, with are incorporated herein by reference. In yet another and/or alternative embodiment of the invention, the filter material includes two or more layers of filter material. The layers of filter material can be the same type of filter material or different types of filter material. In still another and/or alternative embodiment of the invention, the filter material is designed to filter a majority of particles having a particle size of at least about 20 microns. In one aspect of this embodiment, the filter material is designed to filter a majority of particles having a particle size of at least about 10 microns. In another and/or alternative aspect of this embodiment, the filter material is designed to filter a majority of particles having a particle size of at least about 5 microns. In still another and/or alternative aspect of this embodiment, the filter material is designed to filter a majority of particles having a particle size of at least about 2 microns. At the 2 micron level, most fungi, bacteria and/or viruses are filtered from the air. In yet another and/or alternative aspect of this embodiment, the filter material is designed to filter a majority of particles having a particle size of at least about 1 micron. In still yet another and/or alternative aspect of this embodiment, the filter material is designed to filter a majority of particles having a particle size of at least about 0.5 micron. In still another and/or alternative aspect of this embodiment, the filter material is designed to filter a majority of particles having a particle size of about 0.1 micron. The filter efficiencies of the filter material will depend on several factors such as, but not limited to, the level of filtration desired, the pressure drop through the filtration material (i.e. the ability of an individual to breathe through the filter material), the thickness of the filter material, the type of apparel, and/or the location of the filter material on the apparel.

In accordance another and/or alternative aspect of the present invention, there is provided non-apparel items that are made from, or include one or more pieces of, filter fabric that can filter out one or more airborne particles and/or gasses. The filter fabric can be a woven and/or non-woven material. The filter fabric can be made from natural fibers (e.g. cotton, wool, etc.) and/or from synthetic fibers (e.g. polyester, nylon, etc.). The thickness of the filter fabric can be varied depending on the desired filter efficiencies and/or the region of the non-apparel item where the filter fabric is to be used. The filter fabric can be designed to filter airborne particles and/or gasses by mechanical mechanisms (e.g. weave density), by electrical mechanisms (e.g. charged fibers, charged metals, etc.), and/or by chemical mechanisms (e.g. absorptive charcoal particles, adsorptive materials, etc.). In one embodiment of the invention, the filter material includes electrically charged fibers such as, but not limited to, FILTRETE by 3M. In another and/or alternative embodiment of the invention, the filter material includes a high density material similar to material used for medical masks which are used by medical personnel in doctors' offices, hospitals, and the like. Non-limiting examples of such masks are disclosed in U.S. Pat. Nos. 5,596,985; 4,969,457; and 4,589,408 and the United States patents cited and/or referenced therein, all of which are incorporated herein by reference. Other types of masks and the materials used to make the masks include 3M masks such as, but not limited to, the 1800+, 1816, 1818, 1820, 1825, 1826, 1838, 1860 masks, with are incorporated herein by reference. In yet another and/or alternative embodiment of the invention, the filter material includes two or more layers of filter material. The layers of filter material can be the same type of filter material or different types of filter material. In still another and/or alternative embodiment of the invention, the filter material is designed to filter a majority of particles having a particle size of at least about 20 microns. In one aspect of this embodiment, the filter material is designed to filter a majority of particles having a particle size of at least about 10 microns. In another and/or alternative aspect of this embodiment, the filter material is designed to filter a majority of particles having a particle size of at least about 5 microns. In still another and/or alternative aspect of this embodiment, the filter material is designed to filter a majority of particles having a particle size of at least about 2 microns. At the 2 micron level, most fungi, bacteria and/or viruses are filtered from the air. In yet another and/or alternative aspect of this embodiment, the filter material is designed to filter a majority of particles having a particle size of at least about 1 micron. In still yet another and/or alternative aspect of this embodiment, the filter material is designed to filter a majority of particles having a particle size of at least about 0.5 micron. The filter efficiencies of the filter material will depend on several factors such as, but not limited to, the level of filtration desired, the pressure drop through the filtration material (i.e. the ability of an individual to breathe through the filter material), the thickness of the filter material, the type of non-apparel item, and/or the location of the filter material on the non-apparel item.

In accordance with still another and/or alternative aspect of the present invention, the apparel which includes the filter material is clothing that can be at least partially conveniently and/or easily placed over one's mouth, eyes, and/or nose during a potential and/or actual biological incident. Such apparel allows for more convenient and rapid protection during the potential and/or actual biological incident. During a potential and/or actual biological incident, the individual cups or otherwise places the filter material over one's mouth, eyes, and/or nose and then uses the filter material until the incident has passed and/or the individual has removed oneself from the area of incident. The apparel item which includes the filter material can be alternatively or additionally at least partially conveniently and/or easily placed over one's mouth, eyes, and/or nose to reduce the incidence of catching an infectious decease from an infected individual. As such, when an individual is located in a public area (e.g., public transportation, hospital, shopping center, sporting event, office lobby, etc.) and believes or is concerned about potential exposure to an infectious disease, the individual cups or otherwise places the filter material over one's mouth, eyes, and/or nose and then uses the filter material until the concern for potential exposure to an infectious disease has passed or the individual has removed himself/herself from the area of concern. In one embodiment of the invention, the apparel includes, but is not limited to, shirts, blouses, vests, sweaters, undergarments, sweatshirts, jackets, coats, scarfs, head bands, ear muffs, ear and/or neck warmers, handkerchiefs, hats, caps, gloves, neckties, masks (e.g., ski masks, decorative masks (i.e., party masks, Halloween masks, masquerade masks, etc.)), mufflers, dresses, socks, pants, purses, billfolds, diapers, underwear, bras, and the like. These types of apparel can be easily or relatively easily placed over an individual's nose, eyes, and/or mouth during an actual or potential biological incident, and/or used by an individual when the individual believes or is concerned about potential exposure to an infectious disease. The apparel can be continuously used by the individual until the incident has passed and/or the individual has removed oneself from the site of the actual or potential biological incident, and/or area of concern for infection or potential infection from an infectious disease. In another and/or alternative embodiment of the invention, the placement and/or size of the filter material in the apparel is sufficient to allow an individual to cover one's mouth, eyes, and/or nose. In one aspect of this embodiment, the placement and/or size of the filter material on the apparel is sufficient to allow an individual to cover one's mouth, eyes and nose. In another and/or alternative aspect of this embodiment, the placement and/or size of the filter material on the apparel is sufficient to allow an individual to cover one's mouth and nose. In still another and/or alternative aspect of this embodiment, the placement and/or size of the filter material on the apparel is sufficient to allow an individual to cover one's eyes and nose. In yet another and/or alternative aspect of this embodiment, the placement and/or size of the filter material on the apparel is sufficient to allow an individual to cover one's eyes and mouth. In still yet another and/or alternative aspect of this embodiment, the placement and/or size of the filter material on the apparel is sufficient to allow an individual to cover one's eyes. In a further and/or alternative aspect of this embodiment, the placement and/or size of the filter material on the apparel is sufficient to allow an individual to cover one's mouth. In still a further and/or alternative aspect of this embodiment, the placement and/or size of the filter material on the apparel is sufficient to allow an individual to cover one's nose. In still another and/or alternative embodiment of the invention, the apparel can include one or more visual and/or textural indicators to enable an individual to locate the filter material on the apparel. In one aspect of this embodiment, the filter material on the apparel is a different color from at least a portion of other fabric on the apparel that is at least closely adjacent to the filter material. In another and/or alternative aspect of this embodiment, the filter material on the apparel has a different weave and/or thickness from at least a portion of other fabric on the apparel that is at least closely adjacent to the filter material. In still another and/or alternative aspect of this embodiment, the apparel includes one or more markings that at least partially identify the location of the filter material. In yet another and/or alternative aspect of this embodiment, the filter material on the apparel has a different texture from at least a portion of other fabric on the apparel that is at least closely adjacent to the filter material.

In accordance with yet another and/or alternative aspect of the present invention, the non-apparel item which includes the filter material can be at least partially conveniently and/or easily placed over one's mouth, eyes, and/or nose during a potential and/or actual biological incident. Such non-apparel item allows for more convenient and rapid protection during the potential and/or actual biological incident. During a potential and/or actual biological incident, the individual cups or otherwise places the filter material over one's mouth, eyes, and/or nose and then uses the filter material until the incident has passed and/or the individual has removed oneself from the area of incident. The non-apparel item which includes the filter material can be alternatively or additionally at least partially conveniently and/or easily placed over one's mouth, eyes, and/or nose to reduce the incidence of catching an infectious decease from an infected individual. As such, when an individual is located in a public area (e.g., public transportation, hospital, shopping center, sporting event, office lobby, etc.) and is concerned about potential exposure to an infectious disease, the individual cups or otherwise places the filter material over one's mouth, eyes, and/or nose and then uses the filter material until the concern for potential exposure to an infectious disease has passed or the individual has removed himself/herself from the area of concern. In one embodiment of the invention, the non-apparel item includes, but is not limited to, blankets, throws, quilts, sheets, pillow cases, bed skirts, mattress pads, mattress covers, pillows, towels, wash cloths, curtains, blinds, window shades, rugs, cloths, placemats, napkins, table cloths, coasters, rags, sponges, hot pads, valances, drapes, armchair covers, and the like. These types of non-apparel items can be easily or relatively easily placed over an individual's nose, eyes, and/or mouth during an actual or potential biological incident, and/or used by an individual when the individual believes or is concerned about potential exposure to an infectious disease. The non-apparel item can be continuously used by the individual until the incident has passed and/or the individual has removed oneself from the site of the actual or potential biological incident, and/or area of concern for infection or potential infection from an infectious disease. In another and/or alternative embodiment of the invention, the placement and/or size of the filter material in the non-apparel item is sufficient to allow an individual to cover one's mouth, eyes and nose. In another and/or alternative aspect of this embodiment, the placement and/or size of the filter material on the non-apparel item is sufficient to allow an individual to cover one's mouth and nose. In still another and/or alternative aspect of this embodiment, the placement and/or size of the filter material on the non-apparel item is sufficient to allow an individual to cover one's eyes and nose. In yet another and/or alternative aspect of this embodiment, the placement and/or size of the filter material on the non-apparel item is sufficient to allow an individual to cover one's eyes and mouth. In still yet another and/or alternative aspect of this embodiment, the placement and/or size of the filter material on the non-apparel item is sufficient to allow an individual to cover one's eyes. In another and/or alternative aspect of this embodiment, the placement and/or size of the filter material on the non-apparel item is sufficient to allow an individual to cover one's mouth. In still a further and/or alternative aspect of this embodiment, the placement and/or size of the filter material on the non-apparel item is sufficient to allow an individual to cover one's nose. In still another and/or alternative embodiment of the invention, the non-apparel item can include one or more visual and/or textural indicators to enable an individual to locate the filter material on the non-apparel item. In one aspect of this embodiment, the filter material on the non-apparel item is a different color from at least a portion of other fabric on the non-apparel item that is at least closely adjacent to the filter material. In another and/or alternative aspect of this embodiment, the filter material on the non-apparel item has a different weave and/or thickness from at least a portion of other fabric on the non-apparel item that is at least closely adjacent to the filter material. In still another and/or alternative aspect of this embodiment, the non-apparel item includes one or more markings that at least partially identify the location of the filter material. In yet another and/or alternative aspect of this embodiment, the filter material on the non-apparel item has a different texture from at least a-portion of other fabric on the non-apparel item that is at least closely adjacent to the filter material.

In accordance with still yet another and/or alternative aspect of the present invention, the apparel item which includes the filter material is in the form of a tie, scarf, handkerchief or decorative mask. In the business community, ties are commonly used by men, and scarves are commonly used by women. The incorporation of a filter material in these items provides convenient and readily accessible protection to such individuals without causing such individuals to alter their dressing habits or routines. The ties and/or scarves can be made of silk and/or have fashionable prints to hide or disguise the filter material to make the ties and/or scarves more acceptable to the consumer. Handkerchiefs are provided for individuals that do not wear ties or scarves to work, or are at an event and/or location where ties and/or scarves are typically not worn (e.g., sporting events, shopping malls, concerts, restaurants, nightclubs, etc.). The handkerchief can conveniently be placed in the pocket or purse of an individual and used when desired. Decorative masks are used by individuals that desire to wear a protective mask in the public. The mask is decorated with one or more colors and/or designs to provide a fashion statement in addition to providing protection to the individual.

In accordance with a further and/or alternative aspect of the present invention, the apparel and/or non-apparel item which includes the filter material can be used to at least partially protect and/or shield an individual from undesired environmental conditions other than a potential and/or an actual biological incident. Such undesired environmental conditions include, but are not limited to, air pollutants (e.g., smoke, chemical emissions, etc.), dust, pollen, insects, spores, vehicle emissions, factory emissions, bacteria, viruses, and/or other undesirable particles and/or gasses in the air. As a result, the apparel allows for convenient and rapid protection from undesired environmental conditions. In one example, an individual could cover one's nose, eyes, and/or mouth when exposed to unacceptable dust and/or dirty environments. In another and/or alternative example, an individual could cover one's nose, eyes, and/or mouth when in close proximity to sick individuals (e.g., hospital environment, doctor's office, visiting sick individuals, caring for sick individuals, etc.). In still another and/or alternative example, an individual could cover one's nose, eyes, and/or mouth when exposed to allergens (e.g., pollen, spores, etc.). In still another and/or alternative example, an individual could cover one's nose, eyes, and/or mouth when exposed to environments having unacceptable amounts of insects (e.g., forests, swamps, parks, farms, zoos, ponds, lakes, oceans, rivers, etc.). Indeed, when in any environment that is deemed unsafe and/or unacceptable to an individual, the individual can cover his or her nose, eyes, and/or mouth. When in such environment, the individual cups or otherwise places the filter material over one's mouth, eyes, and/or nose and then breathes through the filter material until the individual leaves such environments and/or deems the environment acceptable.

In accordance with still a further and/or alternative aspect of the present invention, the apparel and/or non-apparel item can include a filter material that fully or partially filters undesired gasses (e.g., tear gas, odors, toxic gasses, noxious gasses, etc.) from the air. The filter material is designed to at least partially remove gasses from the air such as, but not limited to, smoke, fumes, gas contaminants, and/or noxious gases. In one embodiment, the filter material incorporates the use of one or more gas absorbing and/or adsorbing substances to absorb and/or adsorb gasses that are drawn into the filter material (e.g. carbon, etc.). The filter material that filters undesired gasses from the air can also function as the particle filter and/or be a separate filter material.

In accordance with a further and/or alternative aspect of the present invention, at least a portion of the filter material in the apparel and/or non-apparel item is non-removable. The filter material is typically non-removably connected by stitch; however, other or additional arrangements can be used such as, but not limited to, glue, melted seam, unsnappable snaps, etc.

In accordance with yet a further and/or alternative aspect of the present invention, at least a portion of the filter material in the apparel and/or non-apparel item is removable. After an individual has passed and/or been exposed to an undesired environment, the individual may want to dispose of the filter material and replace the filter material with new filter material. Alternatively or additionally, an individual may want to clean the apparel or non-apparel item after the individual has passed and/or been exposed to an undesired environment, and therefore may want to remove the filter material so that the filter material will not be damaged when the apparel or non-apparel item is cleaned. In one embodiment, the filter material is detachably connected to the apparel or non-apparel item by a mechanism such as, but not limited to, Velcro, snaps, zippers, buttons, hooks, tongue and groove connectors, laces, straps, magnets, clips, cords, belts, etc.

In accordance with still yet a further and/or alternative aspect of the present invention, the filter material in the apparel and/or non-apparel item is washing machine safe. As a result, the filter material can be cleaned with the apparel and/or non-apparel item without having to remove the filter material from the apparel and/or non-apparel item, or damaging the filter material when cleaning the apparel and/or non-apparel item.

In accordance with another and/or alternative aspect of the present invention, the apparel and/or non-apparel item that includes the filter material can be used to protect animals such as, but not limited to, pets and/or other valuable animals to an individual.

The principal object of the present invention is the provision of a fabric that provides at least partial protection from airborne particles and/or gasses.

Another and/or alternative object of the present invention is the provision of a protective fabric that can be at least partially conveniently and/or easily used by an individual to provide at least partial protection from airborne particles and/or gasses.

Still another and/or alternative object of the present invention is the provision of a protective fabric that is at least partially used in apparel to provide at least partial protection from airborne particles and/or gasses.

Yet another and/or alternative object of the present invention is the provision of a protective fabric that is at least partially used in non-apparel items to provide at least partial protection from airborne particles and/or gasses.

Still yet another and/or alternative object of the present invention is the provision of a protective fabric that is at least partially used to provide at least partial protection to one's nose, mouth and/or eyes from airborne particles and/or gasses.

A further and/or alternative object of the present invention is the provision of an apparel and/or non-apparel item that includes one or more visual indicators for the protective fabric on the apparel and/or non-apparel item.

Still a further and/or alternative object of the present invention is the provision of an apparel and/or non-apparel item that includes one or more textural indicators for the protective fabric on the apparel and/or non-apparel item.

Yet a further and/or alternative object of the present invention is the provision of an apparel and/or non-apparel item that includes a protective fabric that can be easily and/or conveniently removed and/or replaced on or from the apparel and/or non-apparel item.

Still yet a further and/or alternative object of the present invention is the provision of an apparel and/or non-apparel item that includes a protective fabric that can be easily and/or conveniently cleaned.

These and other objects and advantages will become apparent from the discussion of the distinction between the invention and the prior art and when considering the preferred embodiment as shown in the accompanying drawings.

PREFERRED EMBODIMENTS OF THE INVENTION

Figure 1:
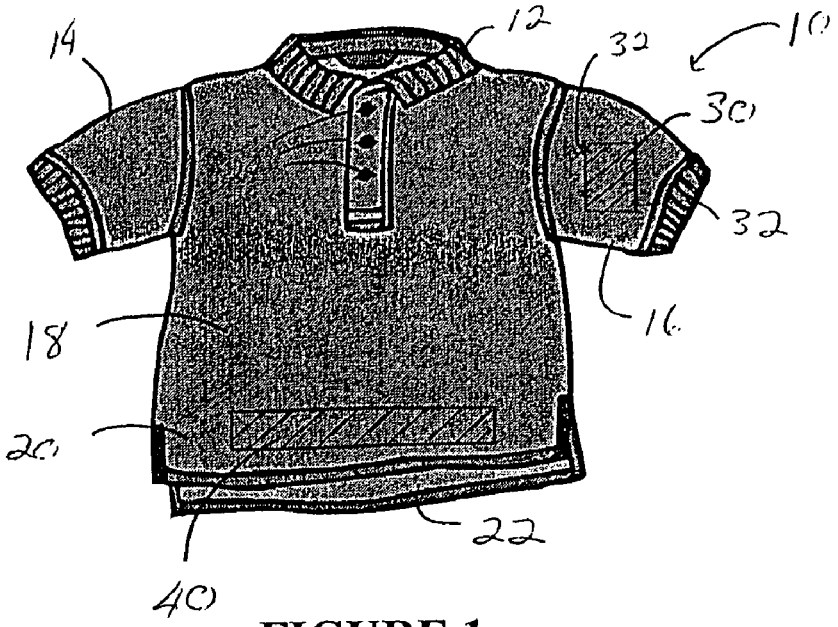
FIG. 1 is a pictorial view of a shirt that includes a protective material on the shirt sleeve and the base of the shirt in accordance with the present invention.

Referring now to the drawings wherein the showings are for the purpose of illustrating the preferred embodiments only and not for the purpose of limiting same, FIG. 1 shows a short sleeve shirt 10. The short sleeve shirt can be designed for a man, woman or child. Shirt 10 includes a collar 12, two sleeves 14, 16, a front 18, a front shirt tail 20, a back shirt tail 22, and buttons 24. Positioned on sleeve 16 is a protective material 30. A protective material 40 is illustrated as being positioned on front shirt tail 20 of the shirt. Protective materials 30 and 40 can be made of the same material or different materials. In addition, protective materials 30 and 40 can have the same or different color. Furthermore, protective materials 30 and 40 can have the same or different texture. Typically, the protective material has a different texture from the other material of the shirt; however, this is not required. The different texture enables a wearer to quickly identify the location of the protective material and use such protective material when desired. The protective material may also have a different color from one or more other portions of the shirt to thereby provide a visual indicator of the location of the protective material; however, this is not required. Typically, the protective material is positioned on and/or incorporated in the shirt such that it blends with the color and/or design of the shirt so as to make the shirt aesthetically desirable to the wearer. As illustrated in FIG. 1, protective material 30, 40 is positioned on shirt 10 in different locations and has a different shape. The protective material typically is selected to filter out at least a majority of particles having a particle size of at least about 2 microns. Typically the protective material is designed to filter a majority of particles such as, but limited to, air pollutants, dust, pollen, insects, spores, vehicle emissions, factory emissions, bacteria, viruses, and/or other undesirable particles and/or gasses in the air. In instances where the protective material is to be used to protect an individual from bacteria and/or viruses in the environment, the protective material is designed to filter out about 90–95% or more of particles that are greater than or equal to about 0.5 micron in size, and more typically filter out about 90–95% or more of particles that are greater than or equal to about 0.1 micron in size. As can be appreciated, other filtering efficiencies can be used for the protective material to accommodate various applications, expectations and/or uses by the individual.

As illustrated in FIG. 1, protective material 30 is secured to sleeve 16 by stitching 32. Protective material 40 is releasably connected to front shirttail 20 by hook and loop connectors. The protective material can be stitched or otherwise firmly attached to the shirt, or be releasably connected to the shirt. When the protective material is firmly attached to the shirt, the protective material is typically at least partially formed of a wash-resistant material so as to allow the shirt to be washed without substantially damaging the protective material. As can be appreciated, the protective material can be made of a wash-resistant material even when the protective material is releasably connected to the shirt. When the protective material is releasably connected to the shirt, the protective material is typically connected to the shirt by a hook and loop arrangement (e.g. Velcro), a zipper, snaps and the like. The releasably connected feature of the protective material enables new protective material to be attached to the shirt.

The protective material on shirt 10 can be used by the user in several ways. Protective material 30 on sleeve 16 can be used by the user merely by the user moving his or her head into the shirt sleeve until the eyes, nose and/or mouth are protected by the protective material. Protective material 40 on front shirttail 20 can be used by the user lifting the shirttail until protective material 40 is positioned over and protects the eyes, nose and/or mouth of the user. Alternatively, protective material 40 can be detached from the front shirttail and moved over the eyes, nose and/or mouth of the user. Consequently, the incorporation of protective material on the shirt of a user provides the user with convenient and quick protection from undesirable particles and/or gasses in the air.

Figure 2:
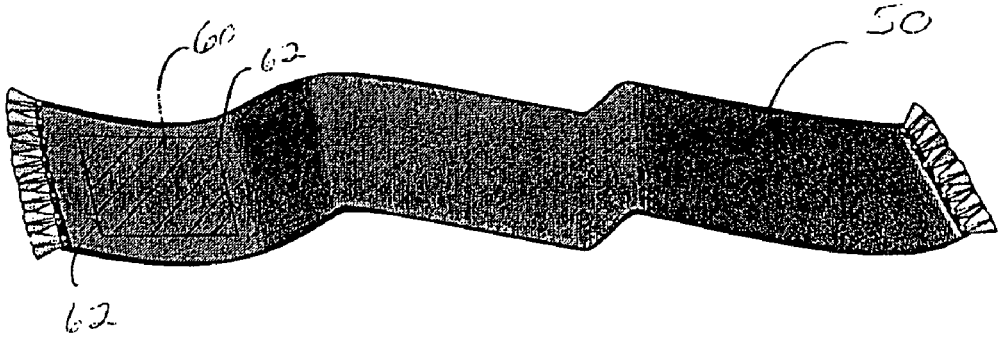
FIG. 2 is a pictorial view of a scarf that includes a protective material in accordance with the present invention.

Referring now to FIG. 2, there is illustrated a scarf 50 that includes a protective material 60 at one end of the scarf. As can be appreciated, the protective material can be positioned in other regions of the scarf. Protective material 60 is illustrated as being connected to the scarf by stitching 62; however, the protective material can be connected in other manners and/or can be releasably connected to the scarf. The protective material typically has a different texture. from the other material of the scarf to enable the user to quickly and conveniently locate the protective material on the scarf. As can be appreciated, the protective material does not have to have a different texture from the other material of the scarf. The protective material on the scarf may have the same or different color from the other material on the scarf. If the color is different, the different color can be used as a visual indicator for the location of the protective material on the scarf. The protective material is typically wash-resistant. The protective material typically is selected to filter out at least a majority of particles having a particle size of at least about 2 microns. Typically the protective material is designed to filter a majority of particles such as, but limited to, air pollutants, dust, pollen, insects, spores, vehicle emissions, factory emissions, bacteria, viruses, and/or other undesirable particles and/or gasses in the air. In instances where the protective material is to be used to protect an individual from bacteria and/or viruses in the environment, the protective material is designed to filter out about 90–95% or more of particles that are greater than or equal to about 0.5 micron in size, and more typically filter out about 90–95% or more of particles that are greater than or equal to about 0.1 micron in size. As can be appreciated, other filtering efficiencies can be used for the protective material to accommodate various applications, expectations and/or uses by the individual.

As illustrated in FIG. 2, the protective material on scarf 50 can be used by the user by moving the protective material on the scarf over the eyes, nose and/or mouth of the user. Consequently, the incorporation of protective material on the scarf of a user provides the user with convenient and quick protection from undesirable particles and/or gasses in the air.

Figure 3:
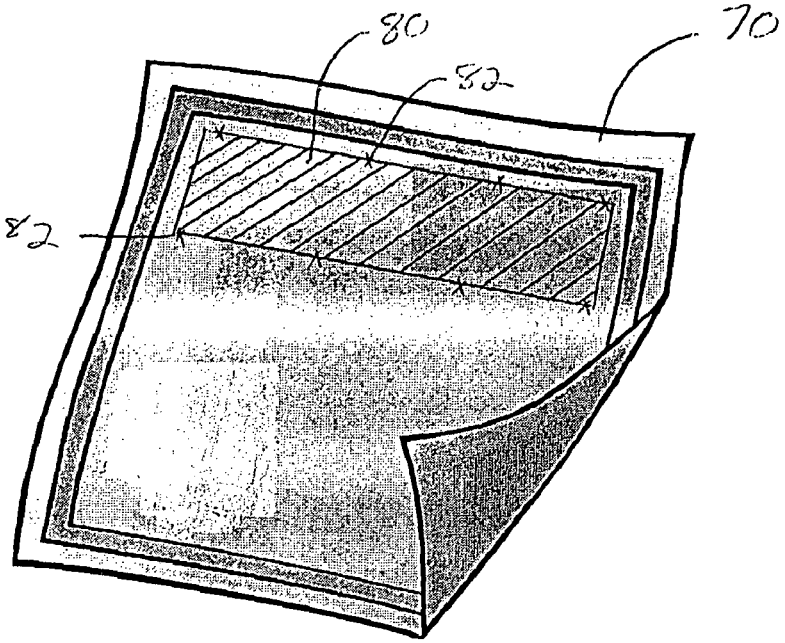
FIG. 3 is a pictorial view of a handkerchief that includes a protective material in accordance with the present invention.

Referring now to FIG. 3, there is illustrated a handkerchief 70 that includes a protective material 80 on a portion of the handkerchief. As can be appreciated, the protective material can be positioned in other regions of the handkerchief. Protective material 80 is illustrated as being connected to the handkerchief by stitching 82; however, the protective material can be connected in other manners and/or can be releasably connected to the handkerchief. The protective material typically has a different texture from the other material of the handkerchief to enable the user to quickly and conveniently locate the protective material on the handkerchief. As can be appreciated, the protective material does not have to have a different texture from the other material of the handkerchief. The protective material on the handkerchief may have the same or different color from the other material on the handkerchief. If the color is different, the different color can be used as a visual indicator for the location of the protective material on the handkerchief. The protective material is typically wash-resistant. The protective material typically is selected to filter out at least a majority of particles having a particle size of at least about 2 microns. Typically the protective material is designed to filter a majority of particles such as, but limited to, air pollutants, dust, pollen, insects, spores, vehicle emissions, factory emissions, bacteria, viruses, and/or other undesirable particles and/or gasses in the air. In instances where the protective material is to be used to protect an individual from bacteria and/or viruses in the environment, the protective material is designed to filter out about 90–95% or more of particles that are greater than or equal to about 0.5 micron in size, and more typically filter out about 90–95% or more of particles that are greater than or equal to about 0.1 micron in size. As can be appreciated, other filtering efficiencies can be used for the protective material to accommodate various applications, expectations and/or uses by the individual.

As illustrated in FIG. 3, the protective material on handkerchief 70 can be used by the user by moving the protective material on the handkerchief over the eyes, nose and/or mouth of the user. Consequently, the incorporation of protective material on the handkerchief of a user provides the user with convenient and quick protection from undesirable particles and/or gasses in the air.

Figure 4:
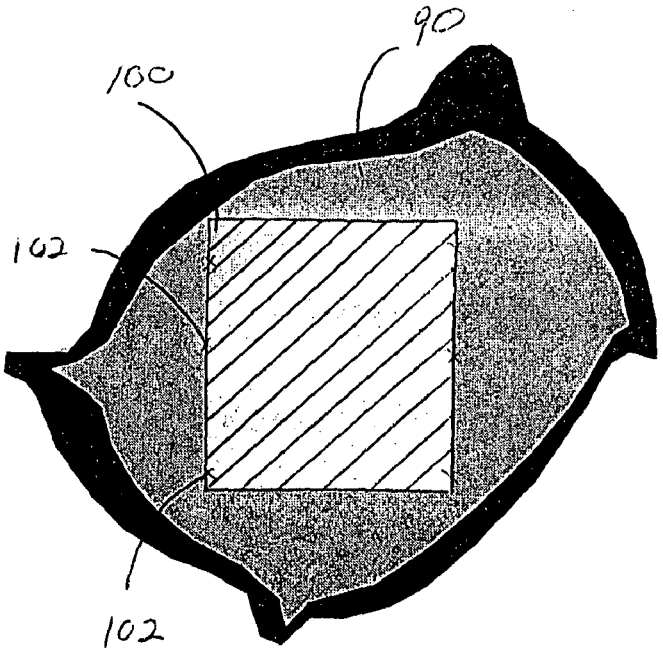
FIG. 4 is a pictorial view of a pillow that includes a protective material in accordance with the present invention.

Referring now to FIG. 4, there is illustrated a pillow case 90 that includes a protective material 100 on a portion of the pillow case. As can be appreciated, the protective material can be positioned in other regions of the pillow case. Protective material 100 is illustrated as being connected to the pillow case by stitching 102; however, the protective material can be connected in other manners and/or can be releasably connected to the pillow case. The protective material typically has a different texture from the other material of the pillow case to enable the user to quickly and conveniently locate the protective material on the pillow case. As can be appreciated, the protective material does not have to have a different texture from the other material of the pillow case. The protective material on the pillow case may have the same or different color from the other material on the pillow case. If the color is different, the different color can be used as a visual indicator for the location of the protective material on the pillow case. The protective material is typically wash-resistant. The protective material typically is selected to filter out at least a majority of particles having a particle size of at least about 2 microns. Typically the protective material is designed to filter a majority of particles such as, but limited to, air pollutants, dust, pollen, insects, spores, vehicle emissions, factory emissions, bacteria, viruses, and/or other undesirable particles and/or gasses in the air. In instances where the protective material is to be used to protect an individual from bacteria and/or viruses in the environment, the protective material is designed to filter out about 90–95% or more of particles that are greater than or equal to about 0.5 micron in size, and more typically filter out about 90–95% or more of particles that are greater than or equal to about 0.1 micron in size. As can be appreciated, other filtering efficiencies can be used for the protective material to accommodate various applications, expectations and/or uses by the individual.

As illustrated in FIG. 4, the protective material on pillow case 90 can be used by the user by moving the protective material on the pillow case over the eyes, nose and/or mouth of the user. Consequently, the incorporation of protective material on the pillow case of a user provides the user with convenient and quick protection from undesirable particles and/or gasses in the air, especially while in bed.

Figure 5:
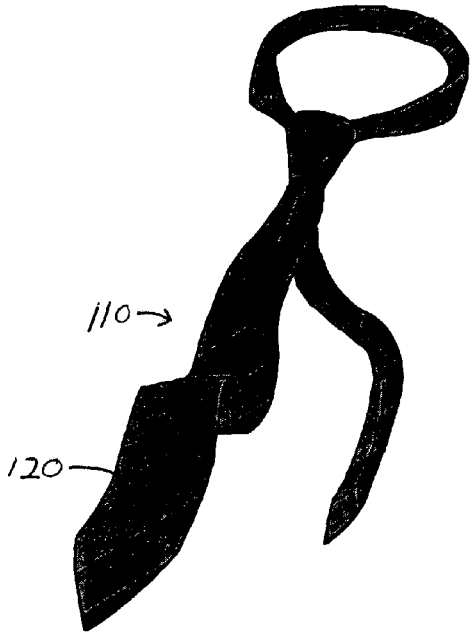
FIG. 5 is a pictorial view of a tie that includes a protective material in accordance with the present invention; and, FIG. 6 is a pictorial view of a decorative mask that includes a protective material in accordance with the present invention.

Referring now to FIG. 5, there is illustrated a tie 110 that includes a protective material 120 on a portion of the tie. As can be appreciated, the protective material can be positioned may different regions of the tie. The tie can be made of a variety of materials such as, but not limited to, silk, linen, cotton, nylon, etc. The tie can also have a variety of designs and/or colors. Protective material 120 is typically connected to the tie by stitching; however, the protective material can be connected in other manners and/or can be releasably connected to the tie. The protective material typically has a different texture from the other material of the tie to enable the user to quickly and conveniently locate the protective material on the tie. As can be appreciated, the protective material does not have to have a different texture from the other material of the tie. The protective material on the tie may have the same or different color from the other material on the tie. If the color is different, the different color can be used as a visual indicator for the location of the protective material on the tie. The protective material is typically wash-resistant. The protective material typically is selected to filter out at least a majority of particles having a particle size of at least about 2 microns. Typically the protective material is designed to filter a majority of particles such as, but limited to, air pollutants, dust, pollen, insects, spores, vehicle emissions, factory emissions, bacteria, viruses, and/or other undesirable particles and/or gasses in the air. In instances where the protective material is to be used to protect an individual from bacteria and/or viruses in the environment, the protective material is designed to filter out about 90–95% or more of particles that are greater than or equal to about 0.5 micron in size, and more typically filter out about 90–95% or more of particles that are greater than or equal to about 0.1 micron in size. As can be appreciated, other filtering efficiencies can be used for the protective material to accommodate various applications, expectations and/or uses by the individual.

As illustrated in FIG. 5, the protective material on tie 110 can be used by the user by moving the protective material on the tie over the eyes, nose and/or mouth of the user. Consequently, the incorporation of protective material on the tie of a user provides the user with convenient and quick protection from undesirable particles and/or gasses in the air.

Figure 6:
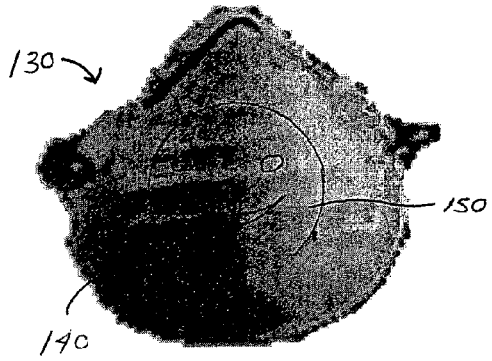

Referring now to FIG. 6, there is illustrated a decorative mask 130 that includes a protective material 140 of the decorative mask. As can be appreciated, the protective material can be positioned in many regions of the decorative mask. As can further be appreciated, the mask itself can be made of the protective material. When the protective material only forms a part of or is connected to a portion of the mask, protective material 140 can be connected to the decorative mask by stitching; however, the protective material can be connected in other manners and/or can be releasably connected to the decorative mask. The protective material typically has a different texture from the other material of the decorative mask to enable the user to quickly and conveniently locate the protective material on the decorative mask. As can be appreciated, the protective material does not have to have a different texture from the other material of the decorative mask. The protective material on the decorative mask may have the same or different color from the other material on the decorative mask. If the color is different, the different color can be used as a visual indicator for the location of the protective material on the decorative mask. The protective material is typically wash-resistant. The protective material typically is selected to filter out at least a majority of particles having a particle size of at least about 2 microns. Typically the protective material is designed to filter a majority of particles such as, but limited to, air pollutants, dust, pollen, insects, spores, vehicle emissions, factory emissions, bacteria, viruses, and/or other undesirable particles and/or gasses in the air. In instances where the protective material is to be used to protect an individual from bacteria and/or viruses in the environment, the protective material is designed to filter out about 90–95% or more of particles that are greater than or equal to about 0.5 micron in size, and more typically filter out about 90–95% or more of particles that are greater than or equal to about 0.1 micron in size. As can be appreciated, other filtering efficiencies can be used for the protective material to accommodate various applications, expectations and/or uses by the individual.

As illustrated in FIG. 6, the protective material on decorative mask 130 can be used by the user by moving the protective material on the decorative mask over the eyes, nose and/or mouth of the user. Consequently, the incorporation of protective material on the decorative mask of a user provides the user with convenient and quick protection from undesirable particles and/or gasses in the air. As shown in FIG. 6, the mask is substantially formed of the protective material and includes a decorative smiling face 150 on the face of the mask. As can be appreciated, many other designs, symbols, etc. can be used. As can further be appreciated, various color schemes for the mask and/or design on the mask can be used.

The present invention has been described with reference to a number of different embodiments. It is to be understood that the invention is not limited to the exact details of construction, operation, exact materials, or embodiments shown and described, as obvious modifications and equivalents will be apparent to one skilled in the art. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

I claim:

1. Apparel that can be used in an emergency or perceived emergency situation to at least partially filter airborne particles, gasses, or combinations thereof to provide at least some level of safety to a human from exposure to potentially unhealthy airborne particles, undesirable airborne particles, potentially unhealthy airborne gasses, undesirable airborne gasses, or combinations thereof, said apparel including a filter material and connected to a non-filter fabric, said filter material designed to filter a majority of particles having a particle size of about 10 microns and greater, the human's eyes, nose, mouth or combination thereof are free of protection from a majority of particles having a particle size of about 2 microns and greater, when said apparel is worn in an ordinary manner, in an ordinary manner not providing protection to the human's eyes, nose, mouth or combination thereof from a majority of particles having a particle size of about 20 microns and greater, said filter material having a size on said apparel to enable the human to reposition at least a portion of said apparel that includes said filter material in a position on the face of the human to enable the human to cover a nose and mouth of the human, to cover the eyes of the human, or combinations thereof with said filter material.

2. The apparel as defined in claim 1, wherein said apparel is selected from the group consisting of a shirt, a blouse, a vest, a sweater, an undergarment, a sweatshirt, a jacket, a coat, a scarf, a head band, an ear muff, an ear warmer, a neck warmer, a handkerchief, a hat, a cap, a glove, a necktie, a scarf, a ski mask, a decorative mask, a muffler, a dress, a sock, pants, a diaper, underwear, a bra, a purse or a billfold.

3. The apparel as defined in claim 2, wherein apparel is selected from the group consisting of a shirt, a blouse, a vest, a sweater, an undergarment, a sweatshirt, a jacket, a coat, a scarf, a head band, ear muffs, an ear warmer, a neck warmer, a handkerchief, a glove, a necktie, mufflers, a dress, a sock, pants or a purse.

4. The apparel as defined in claim 3, wherein apparel is selected from the group consisting of a shirt, a blouse, a vest, a sweater, a sweatshirt, a jacket, a coat, a scarf, a head band, ear muffs, an ear warmer, a neck warmer, a handkerchief, a glove, a necktie, mufflers, or a dress.

5. The apparel as defined in claim 4, a head band, an ear warmer, a neck warmer, a handkerchief, a scarf, or a necktie.

6. The apparel as defined in claim 1, wherein said filter material is able to filter a majority of particles having a particle size of about 2 microns and greater.

7. The apparel as defined in claim 2, wherein said filter material is able to filter a majority of particles having a particle size of about 2 microns and greater.

8. The apparel as defined in claim 4, wherein said filter material is able to filter a majority of particles having a particle size of about 2 microns and greater.

9. The apparel as defined in claim 6, wherein said filter material filters a majority of airborne particles having a particle size of about 0.5 micron and greater.

10. The apparel as defined in claim 7, wherein said filter material filters a majority of airborne particles having a particle size of about 0.5 micron and greater.

11. The apparel as defined in claim 1, wherein said filter material includes a plurality of layers.

12. The apparel as defined in claim 2, wherein said filter material includes a plurality of layers.

13. The apparel as defined in claim 4, wherein said filter material includes a plurality of layers.

14. The apparel as defined in claim 1, including at least one visual indicator, textural indicator, or combinations thereof on said apparel to at least partially indicate the location of said filter material on said apparel.

15. The apparel as defined in claim 2, including at least one visual indicator, textural indicator, or combinations thereof on said apparel to at least partially indicate the location of said filter material on said apparel.

16. The apparel as defined in claim 8, including at least one visual indicator, textural indicator, or combinations thereof on said apparel to at least partially indicate the location of said filter material on said apparel.

17. The apparel as defined in claim 5, including at least one visual indicator, textural indicator, or combinations thereof on said apparel to at least partially indicate the location of said filter material on said apparel.

18. The apparel as defined in claim 1, wherein said filter material is detachably connected to said apparel.

19. The apparel as defined in claim 2, wherein said filter material is detachably connected to said apparel.

20. The apparel as defined in claim 17, wherein said filter material is detachably connected to said apparel.

21. The apparel as defined in claim 17, wherein said filter material is detachably connected to said apparel.

22. The apparel as defined in claim 1, wherein said filter material is at least partially secured to said non-filter fabric by stitching, hook and loop fastener, snap, zipper, button, hook, lace, cord, belt, or combinations thereof.

23. The apparel as defined in claim 2, wherein said filter material is at least partially secured to said non-filter fabric by stitching, hook and loop fastener, snap, zipper, button, hook, lace, cord, belt, or combinations thereof.

24. The apparel as defined in claim 16, wherein said filter material is at least partially secured to said non-filter fabric by stitching, hook and loop fastener, snap, zipper, button, hook, lace, cord, belt, or combinations thereof.

25. The apparel as defined in claim 1, wherein said non-filter fabric constitutes a majority of said apparel.

26. The apparel as defined in claim 2, wherein said non-filter fabric constitutes a majority of said apparel.

27. The apparel as defined in claim 20, wherein said non-filter fabric constitutes a majority of said apparel.

28. The apparel as defined in claim 21, wherein said non-filter fabric constitutes a majority of said apparel.

29. The apparel as defined in claim 24, wherein said non-filter fabric constitutes a majority of said apparel.

30. The apparel as defined in claim 1, wherein said filter material at least partially filters potentially unhealthy airborne gasses, undesirable airborne gasses, or combinations thereof.

31. The apparel as defined in claim 2, wherein said filter material at least partially filters potentially unhealthy airborne gasses, undesirable airborne gasses, or combinations thereof.

32. The apparel as defined in claim 28, wherein said filter material at least partially filters potentially unhealthy airborne gasses, undesirable airborne gasses, or combinations thereof.

33. The apparel as defined in claim 29, wherein said filter material at least partially filters potentially unhealthy airborne gasses, undesirable airborne gasses, or combinations thereof.

34. The apparel as defined in claim 1, wherein said filter material is designed to blend with the non-filter material in color, design or combinations thereof.

35. The apparel as defined in claim 2, wherein said filter material is designed to blend with the non-filter material in color, design or combinations thereof.

36. The apparel as defined in claim 32, wherein said filter material is designed to blend with the non-filter material in color, design or combinations thereof.

37. The apparel as defined in claim 33, wherein said filter material is designed to blend with the non-filter material in color, design or combinations thereof.

38. Apparel that can be used in an emergency or perceived emergency situation to at least partially filter airborne particles, gasses, or combinations thereof to provide at least some level of safety to a human from exposure to potentially unhealthy airborne particles, undesirable airborne particles, potentially unhealthy airborne gasses, undesirable airborne gasses, or combinations thereof, said apparel including a filter material designed to filter a majority of particles having a particle size of about 2 microns and greater, said apparel selected from the human's eyes, nose, mouth or combination thereof are free of protection from a majority of particles having a particle size of about 2 microns and greater, when said apparel is worn in an ordinary manner, group consisting of a headband, an ear warmer, a neck warmer, a handkerchief, a scarf or a necktie, said filter material having a size and located on said apparel to enable the human to reposition and hold a portion of the apparel that includes said filter material in a position on the face of the human to enable the human to cover a nose and mouth of the human, to cover the eyes of the human, or combinations thereof with said filter material.

39. The apparel as defined in claim 38, wherein the human's eyes, nose, mouth or combination thereof are free of protection from a majority of particles having a particle size of about 20 microns and greater, when said apparel is worn in an ordinary manner, when worn in an ordinary manner not providing protection to the eyes, nose or mouth from a majority of particles having a particle size greater than 20 microns.

40. The apparel as defined in claim 38, wherein said apparel is selected from the group consisting of a headband, a handkerchief, an ear warmer, scarf or a necktie.

41. The apparel as defined in claim 38, wherein said apparel includes non-filter material, said filter material is designed to blend with the non-filter material in color, design or combinations thereof.

42. The apparel as defined in claim 39, wherein said apparel includes non-filter material, said filter material is designed to blend with the non-filter material in color, design or combinations thereof.

43. The apparel as defined in claim 38, wherein said filter material filters a majority of airborne particles having a particle size of about 0.5 micron and greater.

44. The apparel as defined in claim 39, wherein said filter material filters a majority of airborne particles having a particle size of about 0.5 micron and greater.

45. The apparel as defined in claim 42, wherein said filter material filters a majority of airborne particles having a particle size of about 0.5 micron and greater.

46. The apparel as defined in claim 38, wherein said filter material includes up to two layers.

47. The apparel as defined in claim 38, including at least one visual indicator, textural indicator, or combinations thereof on said apparel to at least partially indicate the location of said filter material on said apparel.

48. The apparel as defined in claim 39, including at least one visual indicator, textural indicator, or combinations thereof on said apparel to at least partially indicate the location of said filter material on said apparel.

49. The apparel as defined in claim 45, including at least one visual indicator, textural indicator, or combinations thereof on said apparel to at least partially indicate the location of said filter material on said apparel.

50. The apparel as defined in claim 38, wherein said filter material is detachably connected to said apparel.

51. The apparel as defined in claim 39, wherein said filter material is detachably connected to said apparel.

52. The apparel as defined in claim 49, wherein said filter material is detachably connected to said apparel.

53. The apparel as defined in claim 38, wherein said filter material at least partially filters potentially unhealthy airborne gasses, undesirable airborne gasses, or combinations thereof.

54. The apparel as defined in claim 39, wherein said filter material at least partially filters potentially unhealthy airborne gasses, undesirable airborne gasses, or combinations thereof.

55. The apparel as defined in claim 52, wherein said filter material at least partially filters potentially unhealthy airborne gasses, undesirable airborne gasses, or combinations thereof.

56. Non-apparel that can be used in an emergency or perceived emergency situation to at least partially filter airborne particles, gasses, or combinations thereof to provide at least some level of safety to a human from exposure to potentially unhealthy airborne particles, undesirable airborne particles, potentially unhealthy airborne gasses, undesirable airborne gasses, or combinations thereof, said filter material designed to filter a majority of particles having a particle size of about 10 microns and greater, the human's eyes, nose, mouth or combination thereof are free of protection from majority of particles having a particle size of about 20 microns and greater, when said non-apparel is used in an ordinary manner, said non-apparel selected from the group consisting of a blanket, a throw, a quilt, a sheet, a pillow case, a bed skirt, a mattress pad, a mattress cover, a pillow, a towel, a wash cloth, a curtain, a blind, a window shade, a rug, a cloth, a place mat, a napkin, a table cloth, a coaster, a rag, a sponge, a hot pad, a valance, a drape, or an armchair cover, said filter material having a size and located on said non-apparel to enable the human to reposition a portion of the non-apparel that includes said filter material in a position on the face of the human to enable the human to cover a nose and mouth of the human, to cover the eyes of the human, or combinations thereof with said filter material.

57. The non-apparel as defined in claim 56, wherein said filter material is able to filter a majority of particles having a particle size of about 2 microns and greater.

58. The non-apparel as defined in claim 57, wherein said filter material filters a majority of airborne particles having a particle size of about 0.5 micron and greater.

59. The non-apparel as defined in claim 56, wherein said filter material includes up to two layers.

60. The non-apparel as defined in claim 56, including at least one visual indicator, textural indicator, or combinations thereof on said apparel to at least partially indicate the location of said filter material on said apparel.

61. The non-apparel as defined in claim 57, including at least one visual indicator, textural indicator, or combinations thereof on said apparel to at least partially indicate the location of said filter material on said apparel.

62. The non-apparel as defined in claim 56, wherein said filter material is detachably connected to said apparel.

63. The apparel as defined in claim 61, wherein said filter material is detachably connected to said apparel.

64. The non-apparel as defined in claim 56, wherein said filter material is designed to blend with the non-filter material in color, design or combinations thereof.

65. The non-apparel as defined in claim 63, wherein said filter material is designed to blend with the non-filter material in color, design or combinations thereof.

66. The non-apparel as defined in claim 56, wherein said non- apparel includes a filter material and a majority of a non-filter fabric.

67. The non-apparel as defined in claim 65, wherein said non- apparel includes a filter material and a majority of a non-filter fabric.

68. The non-apparel as defined in claim 66, wherein said filter material is at least partially secured to said non-filter fabric by stitching, hook and loop fastener, snap, zipper, button, hook, lace, cord, belt, or combinations thereof

69. The non-apparel as defined in claim 67, wherein said filter material is at least partially secured to said non-filter fabric by stitching, hook and loop fastener, snap, zipper, button, hook, lace, cord, belt, or combinations thereof.

70. The non-apparel as defined in claim 66, wherein said filter material is detachably connected to said non-filter fabric.

71. The non-apparel as defined in claim 67, wherein said filter material is detachably connected to said non-filter fabric.

* * * * *